US006375712B1

(12) United States Patent
Forberg et al.

(10) Patent No.: US 6,375,712 B1
(45) **Date of Patent: *Apr. 23, 2002**

(54) METHOD OF REMOVAL OF LIGHT METALS FROM ALUMINUM

(76) Inventors: Helge O. Forberg, 5118 New Bedford Pl., Marietta, GA (US) 30068; Nolan Earle Richards, 117 Kingswood Dr., Florence, AL (US) 35630

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/222,747

(22) Filed: Dec. 29, 1998

(51) Int. Cl.[7] ..... C22B 21/06

(52) U.S. Cl. ..... 75/680; 75/682; 75/683; 75/684; 75/685

(58) Field of Search ..... 75/683, 680, 682, 75/684, 685; 266/235

(56) References Cited

U.S. PATENT DOCUMENTS 4,470,846 A * 9/1984 Dube ..... 75/685
4,832,740 A * 5/1989 Meier ..... 75/683
5,397,377 A * 3/1995 Eckert ..... 75/680
5,413,315 A * 5/1995 Venas ..... 266/235

* cited by examiner

*Primary Examiner*—Melvyn Andrews
(74) *Attorney, Agent, or Firm*—Herbert M. Hanegan; Dale Lischer; Eric J. Hanson

(57) ABSTRACT

Improved apparatus and method are described for the removal of light metals; sodium, lithium, calcium and magnesium, from virgin aluminum tapped from a Hall Heroult reduction cell using LiF-modified or $LiF+MgF_2$ electrolyte. The method is performed in a crucible or at a station intermediate between the cells and furnaces in a cast house. Fine particulate aluminum fluoride and/or sodium aluminum tetrafluoride are transported by a gas or gas mixture into the molten aluminum in a manner such that the light metals are preferentially removed or their concentration substantially lowered through:

a) the axle of a specially designed spinning impeller;

b) partially through the axle of a specially designed spinning impeller and partially through one or more pipes equipped with dispersers for dispersing into the molten metal flow close to the spinning impeller; or c) through one or more pipes equipped with dispersers for dispersing into the molten metal flow close to the impeller fastened to a solid axle.

24 Claims, 6 Drawing Sheets

METHOD OF REMOVAL OF LIGHT METALS FROM ALUMINUM

FIELD OF THE INVENTION

When aluminum is extracted electrolytically from alumina dissolved in a cryolite-based molten bath ($Na_3AlF_6$+ other stable fluorides), sodium is codeposited with the aluminum. Small proportions of other fluorides are employed, such as lithium fluoride or magnesium fluoride, which can confer advantageous properties on the bath leading to improved economics, resulting in traces of lithium and magnesium in the pool of molten aluminum. The concentrations of these light alkali and alkaline earth metals are dependent upon physical and chemical conditions within the electrolytic reduction cell and the manner in which it is operated. Typical concentrations of sodium, lithium, magnesium, and calcium in freshly tapped molten aluminum metal are in the ranges of from 40 to 180 PPM, 5 to 25 PPM, 5 to 150 PPM, and 4 to 10 PPM respectively and are contaminants which must be removed or lowered to below specifications for the aluminum metal to be marketed for many uses. For many primary aluminum products of casting operations, the specifications require levels of Na and Li to be less than 2 PPM and in some cases as low as 0.5 PPM.

BACKGROUND OF THE INVENTION

The prior art teaches treatment of primary aluminum metal for the removal of traces of alkali metals by passing through a packed bed of carbonaceous material mixed with solid, granular aluminum fluoride, such as disclosed in U.S. Pat. Nos. 3,305,351 and 3,528,801. Although a bed of alternating layers from 1 to 5 feet deep containing from 5 to 90 wt. % $AlF_3$ can treat from 50,000 to 100,000 pounds of primary aluminum metal, there is difficulty in keeping the bed open, porous, and combusting uniformly, promoting the dispersion of aluminum fluoride. The residue from the spent bed presents environmental problems for disposal because it contains potentially hazardous waste material.

U.S. Pat. No. 4,277,280 discloses flowing molten aluminum through a bed of coarse, granular $AlF_3$-containing material wherein the reactive aluminum fluoride can combine with the alkali metals to form a liquid phase and cause clogging of the initial granular bed. Bath components unavoidably tapped with the liquid aluminum from the cells can also react with the $AlF_3$ to form either unwanted liquid or channels in the bed, thus decreasing its effectiveness.

U.S. Pat. No. 4,470,846 discloses removal of contaminating alkali and alkaline earth metals by reaction with aluminum fluoride-yielding material dispersed into a stable vortex in the molten aluminum surface. A rotating impeller with the pitch of the blades designed to force the liquid metal downwardly creates a vortex in the surface of the metal around the shaft connected to a motor. Controlled quantities of granular $AlF_3$ were added into the vortex from a hopper.

U.S. Pat. No. 4,138,246 discloses a filter bed method for lowering the concentration of sodium in molten aluminum, by gravitationally driven flow through a loosely packed filter bed of granular material, which in part, comprises carbon. It suggests that carbon preferentially absorbed a portion of the sodium.

Another form of bed filter for removing sodium, lithium and calcium was described by Achim and Dubé (Light Metals, 1982, pp. 903–916) wherein molten aluminum containing approximately 100 PPM Na and 30 PPM Li flowed through a filter bed of egg-shaped granules of a mixture of cryolite 3%, alumina 9%, and aluminum fluoride 86%.

While this application did remove up to 90% of the light metals, the briquettes forming the bed were consumed and the vessel containing the bed for in-line metal cleaning had to be taken down, cleaned and repacked with $AlF_3$-containing 15–50 mm diameter pellets after processing 1000 to 1500 tons of liquid aluminum.

The Mixal process for treating aluminum in potline crucibles (Archard and Leroy, Light Metals 1990 pp. 765–768) is a prior art method wherein a mixture of gases, chlorine-argon or chlorine-nitrogen is injected into molten aluminum through a spinning nozzle or rotor. After about 11 minutes of treatment the concentrations of sodium and lithium is reduced to 5 and 3 ppm respectively. The products of the reaction are volatile and the effluents are drawn off through a covering lid to a lime injected bag filter capture system. Lack of liquid slag or dross from the reactions depleting the alkali metals is an advantage of this process. However, the risk of recycling chlorides mixed with the fluorides to the reduction cells presents the possibility that untenable corrosion will occur in the electrical connections to the buswork and in the fume capture system of the potrooms.

Primary aluminum is obtained by electrolytic extraction from alumina dissolved in a cryolite-based molten bath ($Na_3AlF_6$+other stable fluorides). Sodium is codeposited with the aluminum during this process along with lithium and magnesium fluorides, which can confer advantageous properties when they are used, resulting in not only sodium but also traces of lithium and magnesium being present in the pool of molten aluminum. The concentrations of these light alkali and alkaline earth metals are dependent upon physical and chemical conditions within the electrolytic reduction cell and the manner in which it is operated. Typical concentrations of sodium, lithium, magnesium, and calcium in freshly tapped molten aluminum metal are in the ranges of from 40 to 180 PPM, 5 to 25 PPM, 5 to 150 PPM, and 4 to 10 PPM respectively.

These metal traces are contaminants which must be removed or lowered for many commercial products. Primarily aluminum many products of casting operations include specifications requiring levels of Na and Li to be less than 2 PPM and sometimes as low as 0.5 PPM.

Although fluxing with gas mixtures such as $N_2$—$Cl_2$, $N_2$—CO—$Cl_2$, Ar—$Cl_2$, and single gases such as argon and nitrogen is routinely practiced in holding furnaces and in launders to remove particles, hydrogen and light metals, this is not a preferred method for decreasing the amounts of Na, Li, Ca, and Mg. These metals form halides, promote the formation of extra dross, react with the refractory lining of the holding/melting furnace and require extended time of fluxing to reduce their concentration in typical virgin primary aluminum to lower levels required in semi-finished aluminum products.

The methods presently practiced to remove or reduce the concentrations of light metals include charcoal filtering in which a tapping crucible of primary aluminum is poured into another crucible containing a bed of burning charcoal and $AlF_3$. The combined effects of the agitation of the metal, reaction with $AlF_3$, oxidation from entrained air, and the propensity for sodium to react with carbon in the presence of fluoride, depress the concentration of Na and Li to about 10 and 5 ppm respectively. In both Alcan and Hycast "Treatment in Crucible" methods, a crucible of virgin molten metal is taken to a station where an impeller is lowered onto the open crucible. In the Alcan method, the rotating impeller creates a vortex into which granular $AlF_3$ is added for a period of 5 to 15 minutes. In the Hycast method granular $AlF_3$ is injected into the metal with an inert carrier gas through a hollow axle and into the metal through a rotating impeller for a period of 5 to 20 minutes. As in the previous methods described, there is enough latent heat for the molten aluminum to remain liquid throughout these treatments. Aluminum fluoride reacts according to the equations:

$$AlF_3+3NaF=Na_3AlF_6$$

$$AlF_3+3LiF=Li_3AlF_6$$

The slags/drosses are skimmed off the surface of the aluminum metal after the rotor is stopped. The treated aluminum metal is thereafter transported to the casthouse holding furnace.

SUMMARY OF THE INVENTION

This novel innovative process for removal of alkali and alkaline earth metals from virgin or primary molten aluminum comprises the apparatus and method for injecting a powdered, vaporizable fluoride carried in a gas stream through a rotating impeller, thus creating bubbles and differential shear forces. This normally is accomplished in the tapping crucible at a specially designed metal cleaning station, advantageously located between the potroom and the cast house. The metal cleaning station, in addition to the necessary controls and ancillary equipment to position and activate the rotor/impeller, regulates the mixture of gases and rate of injection of the fluoride-containing powder. The cleaning station advantageously has two positions at which crucibles of aluminum metal on transports can be treated. Preferably there is also an intermediate position at which the impeller and the shaft connecting to the drive motor can be cleaned of any adhering frozen cryolitic bath. Particulate emissions from the crucible during removal of light metals are captured by means of a lid or cover to the crucible and an exhausting system with a multiclone and baghouse system. The present novel system also provides for the mechanized removal of any solid dross or cryolitic material floating on the surface of the molten aluminum after treatment.

DESCRIPTION OF THE PREFERRED EMBODIMENTS

Figure 1:
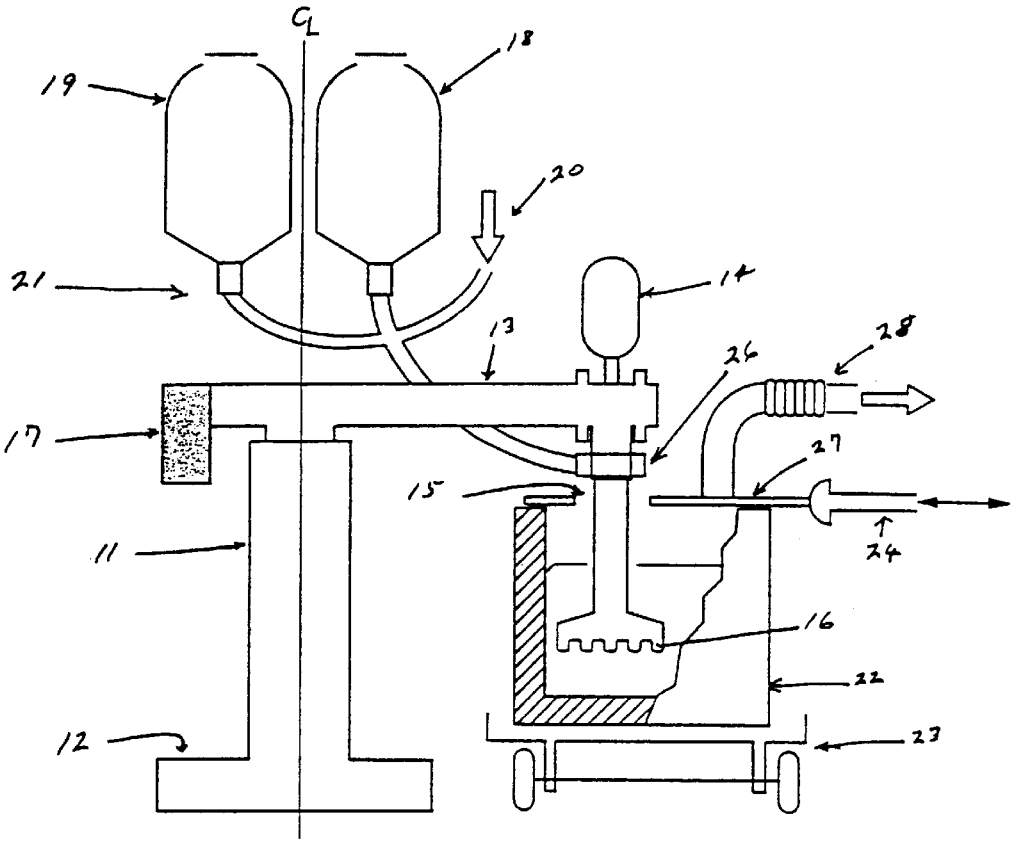
FIG. 1 is a side view of the present invention with a vertical section.

The improvement of the present invention over previous "Treatment in Crucible" methods of removing light metals stems from the more effective way that the fluoride material is added to the molten aluminum and the enhancing effect of the gas stream carrying the particles through the spinning rotor.

The basic chemistry of the present method depends upon the thermodynamics of the reaction between a source of $Al^{3+}$, such as $AlF_3$ or $NaAlF_4$ (aluminum trifluoride and sodium aluminum tetrafluoride respectively) and the contaminant. For the reactions below, the Gibbs free energies are shown for two temperatures in the range in which metal cleaning would occur:

| | Free Energy Change kJ | |
|---|---|---|
| Reaction | $\Delta G_{1000K}$ | $\Delta G_{1200K}$ |
| $3NaAlF_4 + 3Na = 2Na_3AlF_6 + Al$ | −455.0 | −336.8 |
| $3NaAlF_4 + 3Li = Na_3AlF_6 + Li_3AlF_6 + Al$ | −542.3 | −435.2 |
| $AlF_3 + 3Na = 3NaF + Al$ | −163.8 | −147.7 |
| $2AlF_3 + 3Na = Na_3AlF_6 + Al$ | −264.6 | −255.5 |
| $2AlF_3 + 3Li = Li_3AlF_6 + Al$ | −352.0 | −353.9 |
| $AlF_3 + 3Li = 3LiF + Al$ | −310.0 | −306.2 |
| $2AlF_3 + 3Ca = 3CaF_2 + 2Al$ | −668.0 | −674.7 |
| $2AlF_3 + 3Mg = 3MgF_2 + 2Al$ | −298.5 | −350.4 |

A comparison of the free energy changes per unit of alkali metal in the above table reveals that sodium aluminum tetrafluoride is much stronger driving force than aluminum fluoride for removal of both sodium and lithium from molten aluminum.

Another advantage of $NaAlF_4$ over $AlF_3$ is that the vapor pressure is higher. When solid $NaAlF_4$ particles are injected into liquid aluminum in the temperature range of from 750 to 900° C., it immediately begins to sublime or vaporize. The vapor, in the form of and admixed with bubbles of the carrier gas, has a higher rate of reaction than if it, or the reactive fluoride were in solid form. The area of contact of the vapor with the molten metal is the summation of the area of all the bubbles. A 2 mm diameter particle of fluoride at 850° C. has an area of $4.2\times10^{-3}$ $cm^2$, while the same particle when vaporized would have an area of 6.13 $cm^2$; a factor of 1000, which would culminate in forming many individual bubbles. The vapor pressures of compounds used in the present invention are tabulated below.

| | Vapor pressure, torr | |
|---|---|---|
| Compound | 750° C. | 850° C. |
| $AlF_3$ | 0.004 | 0.12 |
| $NaAlF_4$ | 0.8 | 4 |
| $Na_3AlF_6$ | | $<7.4 \times 10^{-4}$ |

The preference for $NaAlF_4$ as the agent for light metal reduction or elimination can be further understood when viewed in terms of the amount of solid powder that can be converted to a gas and stirred into molten aluminum per unit time. It is the purpose of this invention to transport the fluoride down a hollow shaft coupled to a specially configured rotor out of which the carrier gas and initially particulate fluoride is vigorously dispersed into liquid aluminum metal. When the flow rate of the carrier gas is 40 liters/min for average bubble diameters of 2 mm and 5 mm, there would be $655\times10^3$ and $42\times10^3$ bubbles per second respectively at 850° C. When sodium aluminum tetrafluoride enters this stream, there is the capability to vaporize 26 and 10.5 lb/minute. While these amounts decrease to 6.7 lb/min and 2.6 lb/min at 750° C., this is still ten times higher than the equivalent amounts of $AlF_3$ that could be vaporized into the same 2 and 5 mm diameter bubbles.

An additional reason for creating an agitated array of bubbles in the molten aluminum is to promote removal of alkali metals. Sodium boils at 897° C. and Li at 1620° C. At the temperatures likely to be encountered when the crucible of aluminum reaches the metal treatment station, 850° to 750° C., the vapor pressures of Na are 500 and 200 torr and Li, 12 and 0.85 torr, respectively. Therefore there is a strong tendency for these light metals to be vaporized or scavenged into the bubbles of the carrier gas without considering the reactive fluoride content of those bubbles, which will convert the alkali metal to a complex fluoride. The complex fluoride will re-equilibrate to proportions of vapor and liquid phases.

Considering the relative masses and volumes of the carrier gas and either $NaAlF_4$ and/or $AlF_3$ as the reactive substance, the amount of solid particles to be injected into the carrier gas stream advantageously is about 3% by volume.

Depending on the particular combination of gas mixture, solid, particulate source of aluminum cations, and vapor state form of the aluminum compound which extracts Na, Li, Ca or Mg from primary aluminum, the resultant fluoride complex mixture will redistribute among the solid, liquid and vapor phases. This distribution depends upon temperature and the dynamics of the change in composition with increasing proportion of the light metal fluorides in the M(I)F-M(II)-$AlF_3$ product. When $AlF_3$ is used, low melting eutectics such as $NaAlF_4$—NaF with NaF/$AlF_3$ weight ratios in the range of from 0.3 to 1.4 for 80 to 160 PPM Na and 2 to 6 times stoichiometric amounts of reactant are formed. Some of the material with weight ratios in the 0.4 to 0.6 range will vaporize and be carried through the surface of the metal and exhaust to the gas scrubbing system. Because the mixture remains rich in $AlF_3$, a considerable portion with the crucible of metal at 705° C. will be liquid (eutectic temperature, 732° C.). It would be preferable that the portion of the complex NaF-$AlF_3$—LiF that did not vaporize would solidify forming a thin, solid coating o n the surface of the aluminum metal. When the temperature of the metal cools during the metal treatment to about 750° C. it would be desirable to have the freezing point of the mixture of molten salts above that temperature. When $NaAlF_4$ is used and 80 to 160 PPM Na is in the aluminum, 2 to 6 times stoichiometric amounts, the projected weight ratios of NaF/$AlF_3$ are in the range 0.4 to 1. This indicates a greater loss of the complex by vaporization because of the higher portion of $AlF_3$ in the potential dross, a lesser portion in the frozen state and some liquid mixed with the alumina dross at 750° C. Considering this aspect only, the physico-chemical properties resulting from the injection and reaction with light metals are slightly better with aluminum fluoride.

The present invention includes three methods for accomplishing the desired results, namely:

Method 1: The powders and the gases are injected through a hollow axle and an agitator which is connected thereto for discharging into the molten metal.

Method 2: A portion of the powders and the gases are injected into the molten metal by passing through a hollow axle and an agitator and the remaining portion is injected through stationary pipes equipped with dispersers for dispersing into the molten metal flow close to the agitator.

Method 3: A rotating agitator is connected to a solid axle to provide molten metal stirring. One or more stationary pipes equipped with dispersers disperse powder and gases into the molten metal flow close to the agitator.

In Methods 1 and 2, the rotor or impeller has multiple functions. First, it disperses the aluminum-containing particulate into the aluminum metal. Advantageously the rotor has basically an inverse cup shape with either holes in the downwardly projecting rim or alternating projections and spaces. Thus the solid is forced centripetally to the perimeter where strong shear forces exist, stirring the aluminum metal and creating gradients in velocity between the solid particles, which are firther vigorously presented to the liquid aluminum as they vaporize. The impeller also disperses the carrier gas into the metal and because of the high shear at the periphery, very small bubbles are forced out into the liquid creating several flow patterns between the rotor and the inside and lower surfaces of the crucible. Although the impeller may be rotating at from about 80 to about 400 RPM, the amount of disturbance on the surface of the metal is minimal because the shaft has a relatively small diameter and smooth surface. The rotor and shaft are advantageously positioned off-center in the crucible at a depth such that the impressed vertical circulatory flow patterns have decreased or been dampened by the time they reach the surface. With such an arrangement, effective mechanical and gas bubble stirring is achieved, acceleration of the reaction between $NaAlF_4$ or $AlF_3$ and the light metal contaminant is promoted with little disturbance of the surface so that dross formation is minimized.

In Method 3, equivalent results can be achieved as described in Methods 1 and 2, but the equipment configuration is different. Method 3 can be adopted to different equipment designs like the TAC system, however with this system it is necessary to replace the agitator and install a reversible electric motor connected to the axle. For systems having stationary pipes equipped with dispersers, it is also necessary to install a jig connected for movement of the arm so this equipment can be lowered into the molten metal and raised and lowered together with the agitators, with the dispersers maintaining the same distance from the agitator.

Preferably a lid or cover is lowered onto the crucible after the impeller is positioned. An exhaust through the cover leads to a fume control system which captures the particulate fluorides for recycling to the potroom. When a small amount of CO is a component of the carrier gas injection system, this will be oxidized to $CO_2$ when it passes through the meniscus of the liquid aluminum metal. By ingress of normal air any remaining CO will be diluted to well below regulatory threshold limits.

In one configuration of the present invention a third station is intermediate between the two metal treatment stations. At this location the shaft and rotating impeller assembly can be lowered into a vessel or enclosure wherein shot- or sand-blasting can be carried out on the shaft-rotor to remove adhering coatings of frozen cryolitic bath. Controlled mechanical vibrations can be applied to promote removal of adhering bath. The vibrations can be applied with a point contactor coupled to an ultrasonic or magnetostrictor device. For waste minimization, it is possible that alpha-alumina can be used as the abrasive enabling the mixed alumina-bath material to be recycled in the aluminum production process.

Figure 2:
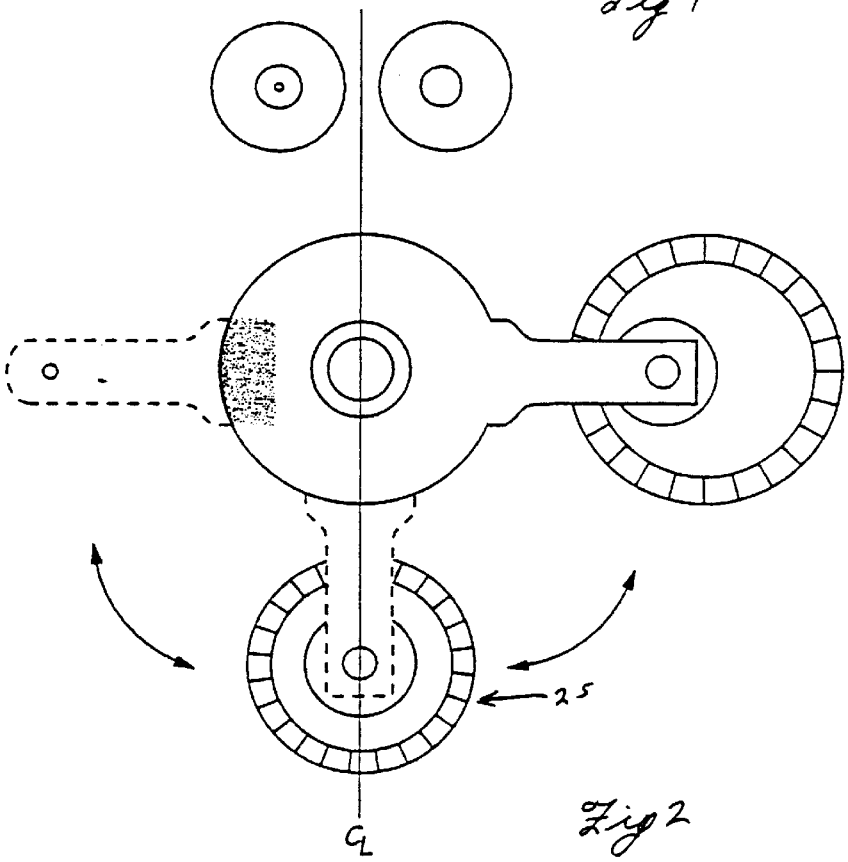
FIG. 2 is a top plan view of the present invention.

One embodiment of the apparatus of the present invention is illustrated in FIG. 1 which depicts a vertical cut of the rotor inside and off-center in a crucible of molten aluminum. The rotor or agitator is coupled to a variable speed, reversible electric motor on an arm pivoted from a central post or column. The arm is capable, preferably hydraulically, of vertical movement sufficient to clear lip of the crucible at Station A. Advantageously there is a duplicate, mirror image Station B 180 degrees opposite. The height and rotation of the arm is actuated and controlled from an automated, programable console (not shown). FIG. 2 is a top plan view looking down on the arm showing a crucible of molten aluminum being transported from the potroom via the metal cleaning station to the casthouse. Between Stations A and B advantageously there is an agitator cleaning station containing a cylindrical tank in which the rotor-shaft can be inserted for periodic cleaning. The pivoting arm can swing past/over this cleaning station to Station B where the system can be immersed and function in another track of crucibles of molten aluminum en route to the casthouse. The apparatus shown in FIG. 1 consists of a vertical column, 11, with the bottom end mounted on a steel plate, 12, which is bolted to a concrete floor foundation. On top of the column, which advantageously is from about 4 to about 6 meters tall, a horizontal arm, 13, is mounted. Preferably the arm is hydraulically capable of 360 degrees horizontal and from about 1 to about 2 meter vertical movements. A variable speed, reversible electric motor, 14, is mounted at one end of the arm and connected, by connector, 26, to a hollow axle, 15, which is fasten to the rotating agitator, 16. A counter weight 17, is attached to the other end of the arm.

Above the column, two hoppers are located for respectively aluminum fluoride, 18, and sodium aluminum tetrafluoride, 19, including a supply line for carrier gas, 20, and valves, feeders, piping and other miscellaneous equipment, 21. The powders in the two hoppers are injected into the gas stream and transported down the hollow axle, out the agitator and into the molten metal in the crucible, 22. The utilities such as electricity, compressed air and hydraulics plus the hoppers for aluminum fluoride and sodium aluminum tetrafluoride as well as the containers for carrier gases are connected to the column and the various equipment of the apparatus. The molten metal is transported from the potrooms via the metal cleaning station to the casthouse advantageously in from about 4 to about 6 ton crucibles placed on a trailer, 23. In the top plan view of the apparatus in FIG. 2, two crucibles can be positioned, advantageously one at the 3 o'clock position and the other at the 9 o'clock position, but only one can be treated at a time. An agitator cleaning station, 25, is preferably located at the 6 o'clock position and a mechanized, automatic dross skimming station, not shown, is preferably located at the 12 o'clock position. The mechanical skimmer is attached to the end of a second arm, not shown, with the other end connected to column, 11, below arm, 13. The second arm is also advantageously hydraulically capable of 360 degrees horizontal and from about 1 to about 2 meter vertical movements. Prior to the treatment an automatic programable console activates the hydraulics to move arm 13 into position and lower the agitator into the liquid metal. A lid, 27, is placed on top of the crucible before starting the treatment and an exhaust pipe, 28, carries the fumes to a scrubbing system during the treatment.

Figure 3:
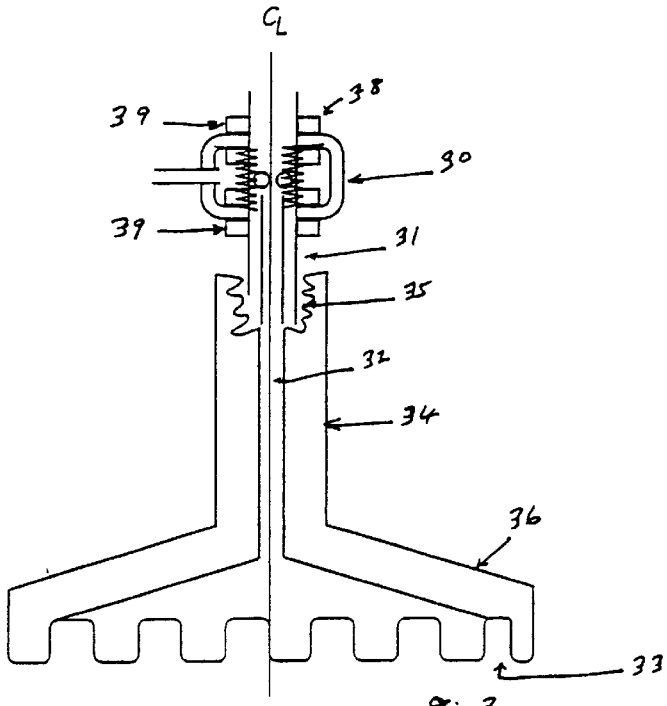
FIG. 3 is a section side view of the rotor/injector of the present invention.
Figure 5:
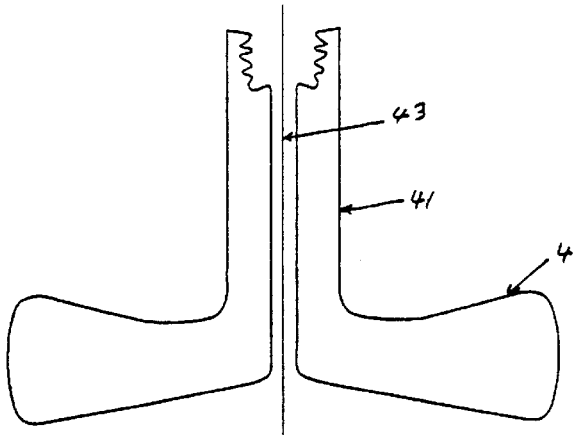
FIG. 5 is a section side view of the rotor/injector of the present invention.
Figure 4:
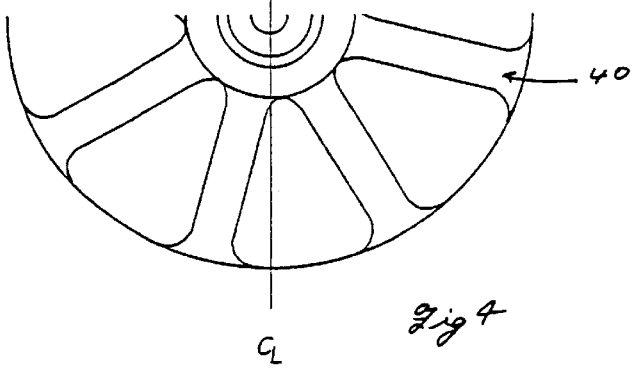
FIG. 4 is a section top view of the rotor/injector of the present invention.

FIGS. 3, 4 and 5 depict advantageous forms of the rotor/injector of the present invention in section. A coupling, 38, connects the drive shaft to the motor. The hollow drive shaft, 31, includes a rotating seal, 30, through which powder can be injected into the gas stream from the hoppers. The powder and the gas stream are transported down hollow portion, 32, of shaft, 31, the rotor/agitator, 33, into the liquid metal. The rotor is lowered, spinning slowly into the liquid metal with the gas flow at a low rate before the valve aspirating the powder into the tubes carrying the powder to an insertion gland is actuated. The rotor/agitator may be of any practical form efficient for dispersing the powder (which can sublime) and setting up both turbulence and shear within the liquid aluminum. FIG. 4 shows a conical hollow rotor with teeth, 40. In one embodiment above the upper conical surface a series of vertical projected blades can be attached along a portion of the radii to increase the shear from the upper surface of the rotor. FIG. 5 shows in section a flatter and thinner rotating disc, 41, with blades/projections, 42, from the lower surfaces of the slightly concave rotor. Such blades/projections can also be from the upper surfaces of the rotor and both advantageously are at about 45 degree intervals, i.e., 8 around the circumference.

FIG. 3 shows coupling 38 with the rotor seals, 39, for the hollow axle, 31, to the electric motor and also connecting to the carrier gas stream with the powders. The lower end of axle 31 is attached to the agitator, 34, through a screw coupling, 35. The carrier gas with the powder travels through hollow axle 31 of agitator 34, expands through the lower part, 36, and is dispersed into the molten metal through the openings, 33, of the lower part of the agitator. FIG. 5 shows an alternate agitator design. The agitator, 41, is equipped with a hollow shaft, 43, and several agitator blades, 42.

Figure 6:
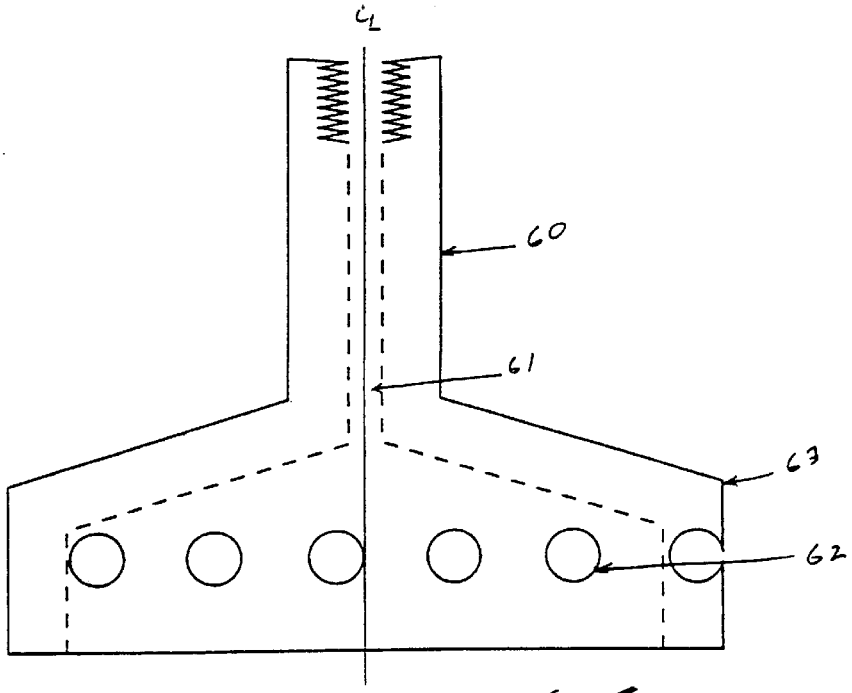
FIG. 6 is a section side view of one embodiment of a rotor/injector of the present invention.
Figure 7:
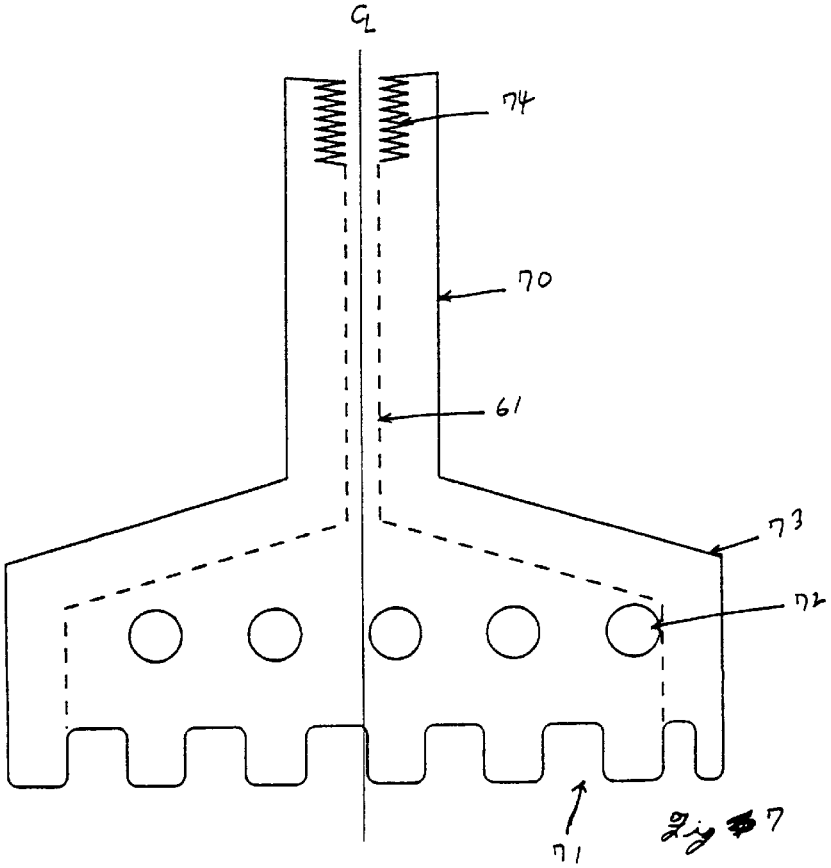
FIG. 7 is a section side view of one embodiment of a rotor/injector of the present invention.

FIGS. 6 and 7 show in a sectional view two alternate rotors/agitators. Both have a conical shape with hollow shafts, 61, which can be easily coupled/decoupled to the drive shaft of the motor. FIG. 6 depicts slots, 62, around the periphery, 63, of the downward projecting lip of the circumference of the rotor, 60. FIG. 7 has a set of teeth, 71, below the level of slots, 72, with the function of increased shear/stiring of the metal to enhance the dispersion of the injected powder and reaction with the light metals, (Na, Li, Ca and Mg), dissolved in the liquid aluminum.

FIG. 6 shows an agitator, 60, in section which has a hollow shaft, 61, wherein the gas stream with the powder can expand in the lower part of the agitator, 63, and be dispersed into the molten metal through the openings in the lower part, 62. FIG. 7 illustrates an agitator, 70, which has a screw connection to the axle, 74, and a hollow shaft, 61. The gas stream with the powder expands in the lower part of the agitator, 73, and is dispersed into the molten metal through the openings, 72, in the lower part, as well stirring the molten metal with teeth, 71, at the bottom part of the agitator, 70.

Figure 8:
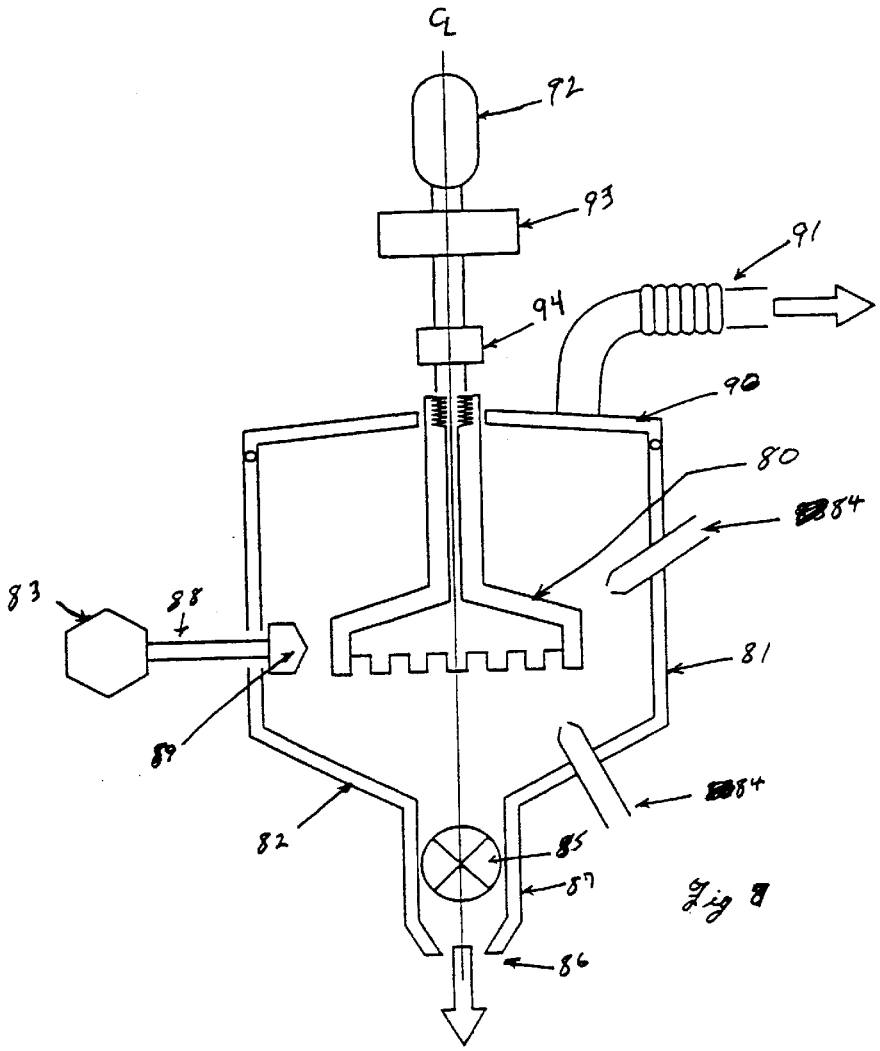
FIG. 8 is a section side view of the cleaning station of the present invention.
Figure 9:
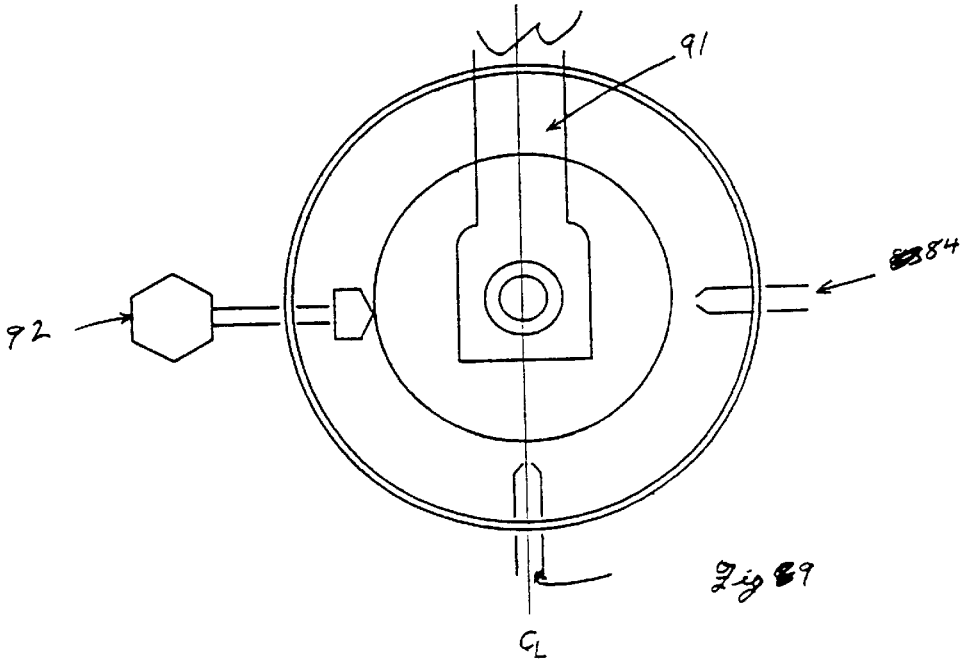
FIG. 9 is a top plan view of the cleaning station of the present invention.

FIGS. 8 and 9 show the cross section and top plan view of the agitator cleaning station. This consists of an enclosed tank, 81, preferably of steel construction, with conical bottom, 82, in which two regimes are brought to bear for any required cleaning of adhering bath from the rotor/lower shaft, 80. The schematic of a horizontally movable shaft, 88, with a slightly pointed head, 89, coupled to a vibrational source, 83, e.g., an ultrasonic driver or a magnetostrictor driver that transmits vibrational energy along shaft 88 to head, 89, pressing against the outside surface of the rotor, 80. Sand blasting wheel(s), 84, projecting through the wall of enclosed tank 81, through which an abrasive powder, advantageously alumina, alpha alumina, or less desirably hard silica sand, can be blasted onto agitator, 80, accomplishes cleaning. The debris falling off the agitator is collected through the valve, 85, at the bottom, 86, of the tank, preferably angled inward at bottom, 87. Because of its cryolite-alumina-white dross-bath composition, recycling to the pots is possible. Semi-circular lids, 90, are hinged at the top of the tank to contain and collect dust which is exhausted through collection means, 91, to the baghouse, advantageously which also collects fumes from the metal cleaning operation.

FIG. 8 shows a variable speed electric motor, 92, a horizontal arm, 93, a connector box with a rotary seal, 94, of the cylindrical vessel, 81, which houses the agitator cleaning station, two sand blasting wheels, 84, an ultrasonic driver, 83, the rotary valve, 85, and the discharge chute, 86, which discharges material to be recycled to the pots. Agitator 80 is shown in position in the cleaning station with closed lids 90 and exhaust pipe 91 transferring the dust to the baghouse. FIG. 9 is a top plan view showing the arm, 91, the sand blasting wheels, 84, and the ultrasonic driver, 92.

Figure 10:
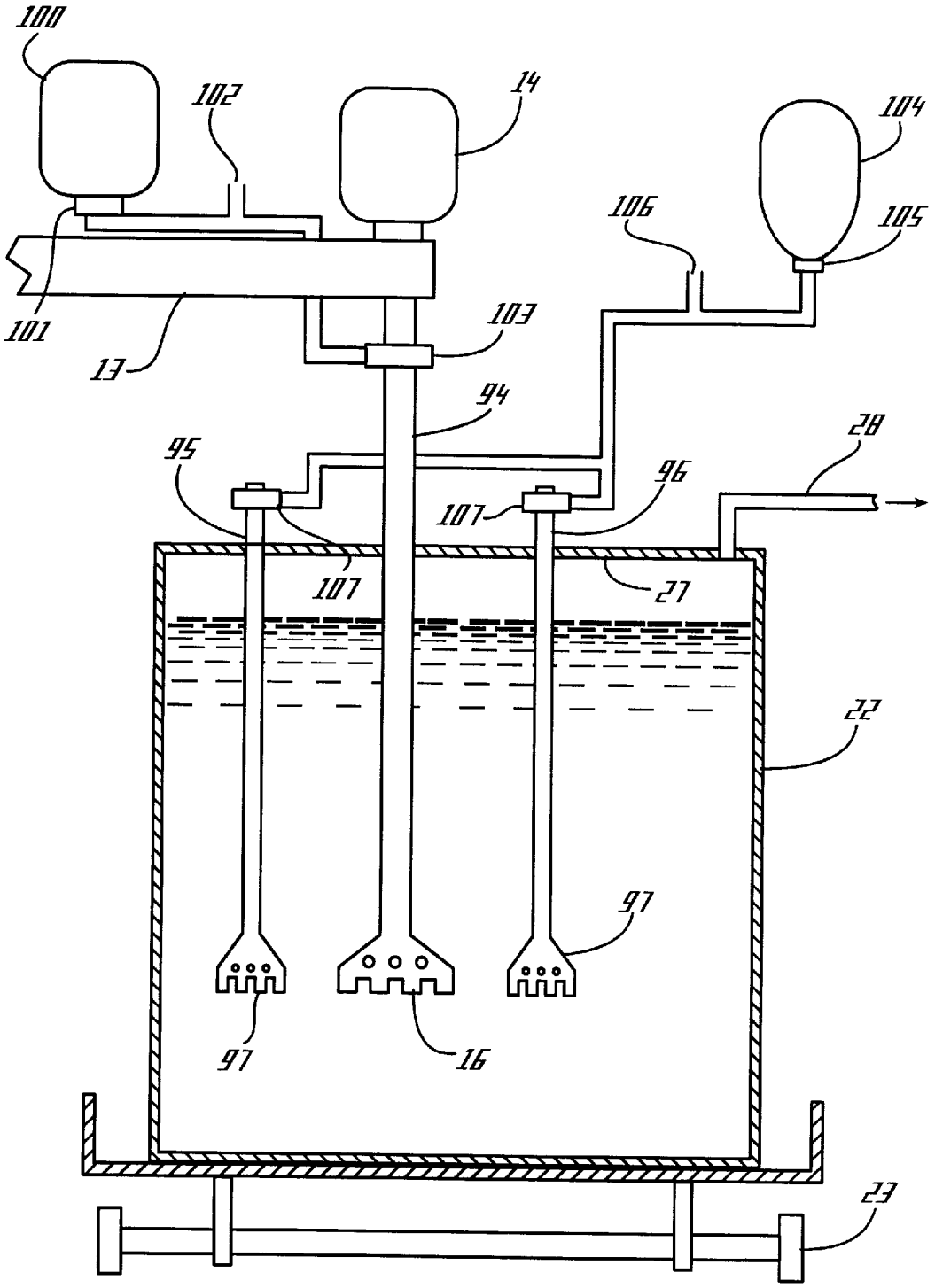
FIG. 10 is a side view of the present invention showing the cleaning station equipped with an agitator fastened to a hollow axle for injection of powder and gas together with one, two or more stationary pipes for dispersing powder and gases into the molten metal flow close to the agitator.

FIG. 10 shows a crucible with molten aluminum, 22, sitting on a trailer, 23, at the cleaning station. On top of the column, a reversible electric motor, 14, is mounted to a horizontal arm, 13, which is hydraulically capable of 360 degree horizontal and about 1 to about 2 meter vertical movements. The electric motor, 14, is mounted by connector, 103, to a hollow axle, 94, which is fastened to the rotating agitator, 16. One hopper, 100, for aluminum fluoride, is located above the column, including a supply line for carrier gas, 102, and valves, feeders, piping and other miscellaneous equipment, 101 and 103.

Also shown are two pipes, 95 and 96, equipped with dispersers, 97, for dispersing powder and gases into the molten metal flow close to the agitator, 16. The pipes are fastened to a jig, and attached to the arm, 13 (not shown), which enables the pipes to move up and down with the agitator and to maintain the dispersing of the powder and gases in the same position in relation to the agitator. One hopper, 104, for sodium aluminum tetrafluoride, is located above the column, and includes a supply line for gases, 106, and valves, feeders, and piping and other miscellaneous equipment, 105 and 107. Furthermore, the crucible is equipped with a lid, 27, for collecting the fumes through the exhaust pipe, 28.

Figure 11:
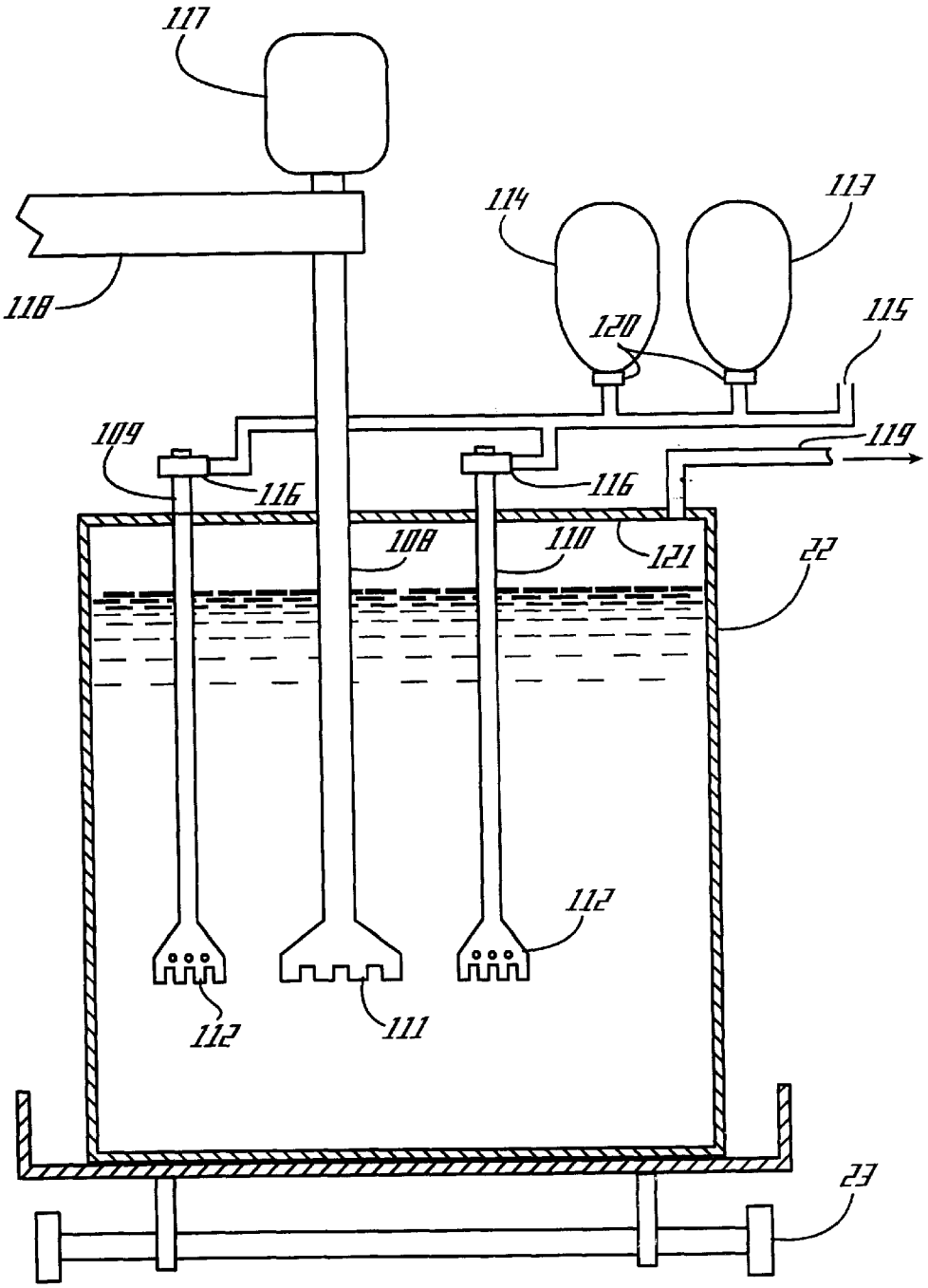
FIG. 11 is a side view of the present invention showing the cleaning station equipped with an agitator fastened to a solid axle together with one, two or more stationary pipes for dispersing powder and gases into the molten metal flow close to the agitator.

FIG. 11 shows a crucible with molten aluminum, 22, on a trailer, 23, at the cleaning station. On top of the column, a reversible electric motor, 117, is mounted to a horizontal arm, 118, which may be hydraulically capable of moving horizontally and vertically. The electric motor is mounted on an axle, 108, which is fastened to the rotating agitator, 111.

Two hoppers are located above the column for containing, respectively, aluminum fluoride, 113, and sodium aluminum tetrafluoride, 114, and include supply line for gases, 115, and valves, feeders, piping and miscellaneous equipment, 116 and 120. The crucible is equipped with a lid, 121, for collecting the fumes through the exhaust pipe, 119.

The present invention includes an apparatus for mixing particulate and gaseous fluoride material with molten aluminum to remove dissolved contaminants such as lithium, sodium, calcium and magnesium from the molten aluminum, said apparatus comprising:

a. a vessel, having a cylindrical internal wall with a vertical geometric axis and an internal diameter D, for containing a body of molten aluminum to a height H above the floor of the vessel;

b. a stirrer comprising an impeller having an opening through its axle and blades for passage therethrough of a carrier gas containing the particulate fluoride into and below the surface of the molten aluminum and having a plurality of blades disposed for immersion in a body of molten aluminum contained within the vessel and means for rotating the impeller about a substantially vertical axis, said impeller having a diameter d and said blades having a height h, the midpoint of said blades being spaced above the floor of the vessel by a distance y, the axis of impeller rotation being spaced from said geometric axis by a distance x, and said blades having major surfaces pitched downwardly at an angle theta to the vertical; or c. a stirrer comprising an impeller fastened to an axle with a plurality of blades disposed for immersion in a body of molten aluminum contained within the vessel and means for rotating the impeller about a substantially vertical axis, and located close to one or more pipes equipped with dispersers for dispersing a carrier gas containing the particular fluorides into the molten metal flow close to the impeller, said impeller having a diameter d and said blades having a height h, the midpoint of said blades being spaced above the floor of the vessel by a distance y, the axis of impeller rotation being spaced from said geometric axis by a distance x, and said blades having major surfaces pitched downwardly at an angle, theta, to the vertical; and d. the values of d, D, h, H, x and theta being such that d/D is between 0.1 and 0.6, h/H is between 0.1 and 0.7, x is between 0 and D/4, y is between 0.25 H and 0.75 H, and theta is between 0° and 45°, at least one of x and theta being greater than zero.

Advantageously, both x and theta are greater than zero and preferably d/D is between 0.15 and 0.40, h/H is between 0.2 and 0.40, x is not greater than d/2, y is between 0.4 H and 0.6 H. and theta is between 30° and 50°. Most preferably, theta is between 40° and 45° and number of said blades is eight.

The present invention further comprises an apparatus for mixing particulate and gaseous fluoride material with molten aluminum to remove dissolved contaminants such as lithium, sodium, calcium and magnesium from the molten aluminum, said apparatus comprising:

a. a vessel, having a geometric axis, for containing a body of molten aluminum; and b. a stirrer comprising an impeller having an opening through its axle and blades for passage therethrough of a carrier gas containing the particulate fluoride into and below the surface of the molten aluminum and having a plurality of blades disposed for immersion in a body of molten aluminum contained within the vessel and means for rotating the impeller in a plane of rotation containing the midpoint of the impeller blades and intersecting said geometric axis, said impeller having a diameter d and said blades having a height h, the midpoint of said blades being spaced above the floor of the vessel by a distance y, the axis of impeller rotation being spaced from said geometric axis by a distance x, and said blades having major surfaces pitched downwardly at an angle theta to the axis of rotation of the impeller, d and x being measured in said plane of rotation and h and y being measured along said axis of rotation; or c. a stirrer comprising an impeller fastened to an axle with a plurality of blades disposed for immersion in a body of molten aluminum contained within the vessel and means for rotating the impeller in a plane of rotation containing the midpoint of the impeller blades, and intersecting said geometric axis, and located close to one or more pipes equipped with dispersers for dispersing a carrier gas containing particular fluorides such as aluminum fluoride and sodium aluminum tetrafluoride into the molten metal flow as close to the impeller as practical, said impeller having a diameter d, and said blades having a height h, the midpoint of said blades being space above the floor of the vessel by a distance y, the axis of impeller rotation being spaced from said geometric axis by a distance x, and said blades having major surfaces pitched downwardly at an angle, theta, to the axis of rotation of the impeller, d and x being measured in said plane of rotation and h and y being measured along said axis of rotation;

d. said vessel having a minimum internal diameter D in said plane of rotation and being adapted to contain molten aluminum to a height H above the floor of the vessel measured along said axis of rotation; and e. the values of d, D, h, H, and theta being such that d/D is between about 0.1 and about 0.6, h/H is between about 0.1 and about 0.7, y is between about 0.25 H and about 0.75 H, and theta is between 0° and about 45° at least one of x and theta being greater than zero, and the minimum spacing between said axis of rotation and the wall of said vessel being at least D/4 measured in said plane of rotation.

The present invention includes a method of removing contaminants such as lithium, sodium, calcium and magnesium from aluminum by bringing the aluminum, in the molten state having the contaminants dissolved therein, into contact with particulate and gaseous fluoride material, said method comprising:

a. delivering said particulate material below the surface of a body of the molten aluminum contained in a vessel having a geometric axis;

b. stirring the molten aluminum to create and maintain agitation therein and delivering said particulate material while stirring and mixing the particulate material with the molten aluminum, thereby to effect a reaction of the particulate material with the dissolved contaminants, the stirring step being performed by rotating, in a plane of rotation and about an axis of rotation, an impeller having a plurality of blades immersed in the molten body;

c. continuing stirring of the molten aluminum until the content of said dissolved contaminants therein is reduced at least to a predetermined level, d. separating the molten aluminum from the products of reaction of the contaminants and the fluoride;

e. wherein the impeller contains an opening through its axle and blades for passage therethrough of a carrier gas containing the particulate fluoride into the molten aluminum; or f. wherein the impeller contains an opening through its axle and blades for passage therethrough of a portion of a carrier gas containing the particulate fluorides into the molten aluminum and also equipped with one or more pipes with dispersers attached for dispersing a portion of a carrier gas containing particulate or gaseous fluorides into the metal flow as close to the impeller as practical; or g. wherein the impeller is fastened to said axle and a carrier gas containing the particulate or gaseous fluorides is dispersed through one or more pipes equipped with dispersers into the metal flow as close to the impeller as practical.

When a crucible of liquid aluminum is positioned at the metal cleaning station, a summary of the preferred cleaning process is described as follows:

before the agitator is lowered into the molten metal the inert gas valve is opened to allow a flow rate of from about 30 to about 60 normal liter/minute.

the agitator is lowered into the metal at a low speed of from about 40 to about 70 rpm.

The agitator speed is increased to about 400 rpm. Aluminum fluoride and/or sodium aluminum tetrafluoride are injected into the gas stream at a rate of from about 0.3 to about 0.7 kg/minute for each of the components. The weight ratio of the two particulate additives advantageously is programmed to change during the treatment of a crucible of molten metal in order to reduce treatment time. The targeted combination of inert (argon or nitrogen) and reactive gas (CO) flow rates are programmed.

The agitator is programmed to change speed and reverse direction about every one to two minutes in order to maximize mixing efficiency.

The chemical reactions which take place to reduce the lithium content in the molten aluminum from about 15 to 30 parts per million (ppm) to about 1 ppm (and the reduction of the other alkali metals as well), and the impact this invention has to speed up the cleaning process are as follows:

lithium will react with the dispersed finely ground aluminum fluoride particles to form lithium fluoride. Effective mixing and large particle surface area of the aluminum fluoride in the liquid metal will speed up the process.

the sodium aluminum tetrafluoride will partially vaporize as it contacts the liquid aluminum and greatly speed up the process to convert lithium to lithium cryolite.

the carrier gas will rapidly transfer the aluminum fluoride and sodium aluminum tetrafluoride particles rapidly into the slower moving liquid aluminum.

the carrier gas will also rapidly transfer the vaporized portion of the sodium aluminum tetrafluoride as bubbles into the molten aluminum for fast reaction.

the circulation of the liquid aluminum will be the highest near the agitator and the slowest near the crucible walls. In order to reach the targeted low concentration of lithium and the other alkali metal impurities in the shortest possible time it is necessary to create a sufficient level of turbulence in the crucible, but not in the surface of the liquid aluminum. This is accomplished by changing the rpm of the agitator and/or reversing the direction at short programmed intervals in addition to raising and lowering the agitator and associated equipment short distances at programmed intervals.

after completion of the mixing, the injection of the powders is stopped while the gas stream is allowed to continue to flow. The rpm of the agitator is reduced to from about 400 to about 70 and the rotor and the associated equipment are lifted out of the metal. The agitator is moved to the agitator cleaning station for cleaning and re-coating as required.

the skimming arm is moved into position above the crucible and the dross on top of the liquid metal is removed with the mechanical skimmer.

After the final metal sample has been taken for chemical analysis, the crucible is transferred to the casthouse for processing.

The critical parts of the equipment advantageously are made of materials such as:

Agitator: graphite, cast iron, high alloy steel, composite materials, and the like.

Hollow axle: graphite, high alloy steel, composite materials, and the like.

Solid axle: graphite, high alloy steel, composite materials, and the like.

Pipes and dispersers: graphite, cast iron, high alloy steel, composite materials, and the like.

In order to minimize the required cleaning time it is advantageous that the agitator be kept free of cryolite and bath buildup as this would reduce the mixing efficiency.

The present invention is designed to achieve the highest possible efficiencies for removing lithium, sodium, magnesium and calcium impurities in liquid aluminum in the shortest possible time. The equipment is built for fast turnaround of the crucibles which is essential for the economics involved.

It will be apparent to those skilled in the art that the objectives and practices of this invention can be achieved by minor modifications to the particular means described herein and with the substitution of other, less effective, but functional fluoride compounds such as a low ratio bath (cryolite with 10 to 12% excess aluminum fluoride or selected reactive gaseous fluorides).

EXAMPLE 1

A crucible containing 5 tons of primary aluminum having 80 PPM Na is delivered to the metal treatment station at a temperature of 805° C. After proper positioning, with a gaseous mixture of 90% $N_2$—10% CO flowing at the rate of 50 liters/min through the shaft, the initially slowly spinning rotor is lowered into the molten aluminum. At the appropriate depth the rotor speed is increased to 160 revolutions per minute, powdered $AlF_3$ of −100 mesh grade (particles mostly 100 microns and smaller), purity 90%, is added to the gas stream at a concentration of 1.26 volume %. This is equivalent to a feed rate of 1.95 lb/min.; four times the stoichiometric amount needed to extract the sodium by chemical reaction or 2.3 lb of $AlF_3$/ton of aluminum. When the carrier gas reaches thermal equilibrium with the metal, which over the 6 minute interval for removal of the sodium to 8 PPM drops in temperature to 800° C. the gas flow through the bubble and shear force-forming holes or openings in the impeller increases to 183 liters/min and the average size of the bubbles are approximately 4 mm (0.16 in diameter). This creates $5.46\times10^6$ bubbles/min into which $AlF_3$ can vaporize. These bubbles also scavenge the light metals, Na, Mg and Ca because of their finite vapor pressures. Thus, the process for removal by chemical reaction between the alkali metal and aluminum fluoride in both the solid and vapor phase is applied to the aluminum and one physical process for removal by extraction of vaporizing light metal into bubbles is also accomplished. This enhancement leads to a decrease in the deliberate excess of reactive fluoride used in industry. With 4 mm bubbles at the average temperature for a six minute duration treatment, the rate of vaporization of $AlF_3$ into the bubbles is 0.19 lb./min. or 10% of the input. After six minutes with the temperature at 800° C., the flow of powder is shut off with the gas still flowing, the impeller is raised out of the metal and the rotational speed lowered to zero. Neglecting complex fluorides of sodium and aluminum that have vaporized and been collected through the cover into the fume abatement system, there will be about 8 to 10 lb of salt liquid at 720° C. on the meniscus. A cold mechanical skimmer can remove this. Two minutes after removal of the lid the crucible of aluminum metal at 780° C. containing 8 PPM Na and 3 PPM Ca can be towed to the cast house.

EXAMPLE 2

7 tons of molten aluminum tapped from a potline operating with a lithium fluoride-modified bath arrives at the treatment station containing 100 PPM Na and 20 PPM Li at a temperature of 840° C. After positioning, the slowly rotating impeller with 40 liter/min of nitrogen flowing there through is lowered eccentrically to a set depth. The speed of the rotor is increased to 200 revolutions per minute and a supply of finely powdered (−140 mesh or largely less than 100 micron diameter) sodium tetrafluoride added to the gas stream. The rate of addition is three times stoichiometric, i.e., 6.6 lb./min. This is equivalent to 5.65 lb./ton of aluminum. The higher speed of rotation results in the average diameter of the bubbles being smaller than in Example 1. For 3 mm (0.12 inch) diameter bubbles the surface area in contact with the metal every second is $2.91\times10^6$ $cm^2$ ($0.46\times10^5$ sq. in.). At an average temperature of 813° C., the amount of $NaAlF_4$ that could be vaporized into those bubbles and presented for rapid reaction and dispersion into the aluminum is 8.8 lb/min. Therefore with $NaAlF_4$ the entire charge can be vaporized in contrast to the $AlF_3$. At the end of six minutes the treatment is terminated, raising the rotor while turning the powder supply off, continuing the gas flow and stopping the impeller. The $NaF/AlF_3$ weight ratio of 0.76 indicate a freezing point of about 750° C., below the temperature of the metal as it leaves the treatment station, 775° C. The vapor pressure of the reactive fluoride combined with the amount of gas flow through the metal and through the surface of the aluminum is adequate to transport most of the complex fluorides to the fume capture system, in which case there would be little or no bath on the metal to be skimmed.

What is claimed is:

1. A method of treating molten aluminum containing contaminants selected from the group consisting of lithium, sodium, calcium and magnesium in a vessel comprising injecting a particulate sublimable source of fluoride into the molten aluminum and subliming the source of fluoride, through a rotating impeller, carried in a transportation gas stream through the periphery of the impeller, in such quantities and for a time sufficient to decrease the concentration of said contaminant.

2. The method of claim 1 wherein the particulate source of fluoride in the transportation gas stream is injected into the molten aluminum partially through the periphery of the impeller and partially through one or more pipes with dispersers for dispersing powder and gases into the molten metal flow close to the impeller.

3. A method of treating molten aluminum containing contaminants selected from the group consisting of lithium, sodium, calcium and magnesium in a vessel comprising injecting a particulate sublimable source of fluoride into the molten aluminum and subliming the source of fluoride, wherein the particulate source of fluoride is injected into the molten aluminum flow close to the impeller only through one or more pipes equipped with dispersers for dispersing a particulate source of fluoride carried in a transportation gas stream into the molten metal flow close to the impeller.

4. The method of claim 3 wherein the axle of the impeller is substantially solid.

5. The method of claim 1 wherein the source of fluoride is in powdered form.

6. The method of claim 2 wherein the source of fluoride is aluminum fluoride.

7. The method of claim 2 wherein the source of fluoride is sodium aluminum tetrafluoride.

8. The method of claim 1 wherein the transportation gas stream is a mixture of nitrogen and carbon monoxide.

9. The method of claim 1 wherein the transportation gas stream is a mixture of carbon monoxide and argon.

10. The method of claim 1 wherein the transportation stream gas is selected from the group consisting of nitrogen, argon and mixtures thereof.

11. The method of claim 1 wherein the impeller includes multiple, pitched, projecting blades, having holes therein adequate to admit powdered fluorides at a rate of from about 0.2 to about 2 kg/minute.

12. The method of claim 3 wherein the impeller includes multiple, pitched, projected blades and wherein powdered fluorides carried in a transportation gas stream is dispersed into the molten metal flow close to the impeller from one or more pipes equipped with dispersers.

13. The method of claim 1 wherein the rotating impeller is mounted and operated eccentrically with respect to the vessel in which molten aluminum is being treated.

14. The method of claim 1 wherein the impeller is rotated in the range of from about 20 to about 400 revolutions/minute.

15. The method of claim 1 including the step of mechanized, automated removing of dross from the surface of the treated molten aluminum metal.

16. A method of removing contaminants from aluminum selected from the group consisting of lithium, sodium, calcium and magnesium by bringing the aluminum in the molten state having the contaminants dissolved therein, into contact with a particulate fluoride material, comprising:

a. delivering s aid particulate material below the surface of a body of the molten aluminum contained in a vessel having a geometric axis and subliming the particulate material;

b. stirring the molten aluminum to create and maintain agitation therein and delivering said fluoride material while stirring and mixing the material with the molten aluminum, thereby to effect a reaction of the material with the dissolved contaminants, the stirring step being performed by rotating, in a plane of rotation and about an axis of rotation, an impeller having a plurality of blades immersed in the molten body;

c. continuing stirring of the molten aluminum until the content of said dissolved contaminants therein is reduced at least to a predetermined level; and d. separating the molten aluminum from the products of reaction of the contaminants and the fluoride;

wherein the impeller contains an opening through its axle and blades for passage therethrough of a carrier gas containing the particulate fluoride into the molten aluminum.

17. The method of claim 1, including the step of creating a level of turbulence in the vessel by changing the rpm of the impeller and reversing the direction at short intervals in addition to moving the impeller and associated equipment up and down at programmed intervals to obtain a low concentration of lithium and other alkali metal impurities in molten aluminum in the shortest possible time.

18. A method of removing contaminant alkali metals from aluminum by bringing the aluminum in the molten state having the contaminants dissolved therein, into contact with a particulate fluoride material, comprising:

a. delivering said particulate material below the surface of the molten aluminum contained in a vessel having a geometric axis and subliming the particulate material, b. stirring the molten aluminum to create and maintain agitation therein and delivering said fluoride material while stirring and mixing the material with the molten aluminum, thereby to effect a reaction of the material with the dissolved contaminants, the stirring step being performed by rotating, in a plane of rotation and about an axis of rotation, an impeller having a plurality of blades immersed in the molten body, c. continuing stirring of the molten aluminum until the content of said dissolved contaminants therein is reduced at least to a predetermined level; and d. separating the molten aluminum from the products of reaction of the contaminants and the fluoride;

wherein the impeller contains an opening through its axle and blades for passage therethrough of a carrier gas containing the particulate fluoride into the molten aluminum.

19. A method according to claim 18, wherein said impeller blades are pitched, each having a major surface facing downwardly at an acute angle to the axis of rotation of the impeller, and wherein the direction of rotation of the impeller is such that said major surfaces are the leading surfaces of the blades.

20. A method according to claim 18, wherein the axis of rotation of the impeller is disposed eccentrically with respect to the geometric axis of the vessel in the plane of rotation of the impeller.

21. A method of removing contaminant alkali metals from aluminum by bringing the aluminum in the molten state having the contaminants dissolved therein, into contact with a particulate fluoride material, comprising:

a. delivering said particulate material below the surface of the molten aluminum contained in a vessel having a geometric axis and subliming the particulate material;

b. stirring the molten aluminum to create and maintain agitation therein and delivering said fluoride material while stirring and mixing the material with the molten aluminum, thereby to effect a reaction of the material with the dissolved contaminants, the stirring step being performed by rotating, in a plane of rotation and about an axis of rotation, an impeller having a plurality of blades immersed in the molten body;

c. continuing stirring of the molten aluminum until the content of said dissolved contaminants therein is reduced at least to a predetermined level; and d. separating the molten aluminum from the products of reaction of the contaminants and the fluoride;

wherein the impeller contains an opening through its axle and blades for passage therethrough for injecting a portion of the particulate fluoride and wherein the other portion of the fluoride material contained in a carrier gas is injected through one or more pipes with dispersers for dispersing into the molten metal flow close to the impeller.

22. A method of removing contaminant alkali metals from aluminum by bringing the aluminum in the molten state having the contaminants dissolved therein, into contact with a particulate fluoride material, comprising:

a. delivering said particulate material below the surface of the molten aluminum contained in a vessel having a geometric axis and subliming the particulate material;

b. stirring the molten aluminum to create and maintain agitation therein and delivering said fluoride material while stirring and mixing the material with the molten aluminum, thereby to effect a reaction of the material with the dissolved contaminants, the stirring step being performed by rotating, in a plane of rotation and about an axis of rotation, an impeller having a plurality of blades immersed in the molten body;

c. continuing stirring of the molten aluminum until the content of said dissolved contaminants therein is reduced at least to a predetermined level; and d. separating the molten aluminum from the products of reaction of the contaminants and the fluoride;

e. wherein the particulate source of fluorides is contained in a carrier gas and injected through one or more pipes equipped with dispersers for dispersing into the molten metal flow close to the impeller mounted on a solid axle.

23. A method of removing contaminants from aluminum selected from the group consisting of lithium, sodium, calcium and magnesium by bringing the aluminum, in the molten state having the contaminants dissolved therein, into contact with a particulate fluoride material, comprising:

a. delivering said particulate material below the surface of a body of the molten aluminum contained in a vessel having a geometric axis and subliming the particulate material;

b. stirring the molten aluminum to create and maintain agitation therein and delivering said fluoride material while stirring and mixing the material with the molten aluminum, thereby to effect a reaction of the material with the dissolved contaminants, the stirring step being performed by rotating, in a plane of rotation and about an axis of rotation, an impeller having a plurality of blades immersed in the molten body;

c. continuing stirring of the molten aluminum until the content of said dissolved contaminants therein is reduced at least to a predetermined level; and d. separating the molten aluminum from the products of reaction of the contaminants and the fluoride;

wherein the impeller is fastened to a solid axle and a carrier gas containing the particulate fluorides is dispersed into the molten metal flow close to the impeller through one or more pipes equipped with dispersers.

24. A method of removing contaminants from aluminum selected from the group consisting of lithium, sodium, calcium and magnesium by bringing the aluminum in the molten state having the contaminants dissolved therein, into contact with a particulate fluoride material, comprising:

a. delivering said particulate material below the surface of a body of the molten aluminum contained in a vessel having a geometric axis and subliming the particulate material;

b. stirring the molten aluminum to create and maintain agitation therein and delivering said fluoride material while stirring and mixing the material with the molten aluminum, thereby to effect a reaction of the material with the dissolved contaminants, the stirring step being performed by rotating, in a plane of rotation and about an axis of rotation, an impeller having a plurality of blades immersed in the molten body;

c. continuing stirring of the molten aluminum until the content of said dissolved contaminants therein is reduced at least to a predetermined level; and d. separating the molten aluminum from the products of reaction of the contaminants and the fluoride;

wherein the impeller contains an opening through the axle and blades for passage therethrough of a portion of the particulate fluoride in a carrier gas and wherein the other portion of the fluoride material and carrier gas is injected through one or more pipes with dispersers for dispersing into the molten metal flow close to the impeller.

* * * * *

UNITED STATES PATENT AND TRADEMARK OFFICE

CERTIFICATE OF CORRECTION

PATENT NO. : 6,375,712 B1
APPLICATION NO. : 09/222747
DATED : April 23, 2002
INVENTOR(S) : Helge O. Forberg et al.

It is certified that error appears in the above-identified patent and that said Letters Patent is hereby corrected as shown below:

Title page, item [63]
The Related U.S. Application Data should be added as follows:

Related U.S. Application Data

(63) Continuation-in-part of application No. 09/085,495, filed on May 27, 1998 (abandoned).

Signed and Sealed this

Twenty-seventh Day of November, 2007

JON W. DUDAS
*Director of the United States Patent and Trademark Office*